US006643898B1

(12) United States Patent
Cameron et al.

(10) Patent No.: US 6,643,898 B1
(45) Date of Patent: Nov. 11, 2003

(54) SELF-CENTERING PIVOT DOOR HINGE SYSTEM

(75) Inventors: Robert D. Cameron, Ponte Vedra Beach, FL (US); E. Jeffrey Dowd, Jacksonville, FL (US)

(73) Assignee: Southeastern Aluminum Products, Inc., Jacksonville, FL (US)

( * ) Notice: Subject to any disclaimer, the term of this patent is extended or adjusted under 35 U.S.C. 154(b) by 0 days.

(21) Appl. No.: 10/151,214

(22) Filed: May 18, 2002

(51) Int. Cl.[7] ..... E05D 5/00; E05D 1/02

(52) U.S. Cl. ..... 16/382; 16/309; 16/315; 16/317

(58) Field of Search ..... 16/382, 312–315, 16/317, 309, 229, 230, 231; 160/199, 196.1, 206, 213; 49/397, 399, 381

(56) References Cited

U.S. PATENT DOCUMENTS

| | | | | | |
|---|---|---|---|---|---|
| 1,312,667 | A | | 8/1919 | Ayres | |
| 1,318,824 | A | | 10/1919 | Alary | |
| 2,284,074 | A | | 5/1942 | Stahl | |
| 3,378,881 | A | * | 4/1968 | Hentzi et al. | 16/312 |
| 3,390,486 | A | | 7/1968 | Walters | |
| 3,546,736 | A | * | 12/1970 | Booth | 16/312 |
| 3,648,327 | A | * | 3/1972 | Edeus | 16/236 |
| 3,722,031 | A | * | 3/1973 | Bourgeois | 16/317 |
| 3,858,274 | A | * | 1/1975 | Burton et al. | 16/312 |
| 4,090,274 | A | * | 5/1978 | Bourgeois | 16/317 |
| 4,200,956 | A | | 5/1980 | Ullman, Jr. | |
| 4,787,120 | A | * | 11/1988 | Haigh | 16/317 |
| 4,897,889 | A | | 2/1990 | Baus | |
| 5,417,272 | A | | 5/1995 | Marlowe | |
| 5,613,276 | A | | 3/1997 | Franz | |
| 5,867,869 | A | | 2/1999 | Garrett | |
| 5,908,064 | A | | 6/1999 | Bruce | |
| 6,035,460 | A | | 3/2000 | Borter | |
| 6,070,294 | A | | 6/2000 | Perkins | |
| 6,161,255 | A | | 12/2000 | Garrett | |

* cited by examiner

*Primary Examiner*—Chuck Y. Mah
(74) *Attorney, Agent, or Firm*—Thomas C. Saitta

(57) ABSTRACT

A pivot door hinge having a door receiving channel member pivotally connected to a fixed base plate member, the base plate member having a pair of opposing parallel ridge members defining an alignment channel, such that the channel member is retained within the alignment channel until pivoted from the centered orientation, whereby the channel member rests on the ridge members.

20 Claims, 3 Drawing Sheets

SELF-CENTERING PIVOT DOOR HINGE SYSTEM

BACKGROUND OF THE INVENTION

This invention relates generally to the field of door or panel hinges, and more particularly to the field of pivot hinges attached to the top and bottom edges of the door or panel member. Even more particularly, the invention relates to such hinges that are self-centering or self-aligning, whereby the structure of the hinge causes the door or panel to seat in a preferred position when closed.

Pivot door hinges are well known in the field of doors, gates, shower doors and any panel members that open in a non-sliding manner by pivoting about a vertical axis. A typical pivot hinge comprises a vertically oriented post or pin member connecting a mounting portion of the hinge attached to the top and bottom edges of a panel to a fixed portion of the hinge attached to the base, curb, soffit, header or wall.

Pivot hinges are of particular use with glass shower doors, where modern aesthetics prefers door mounting systems which utilize the least amount of hardware to provide a clean and uncluttered visual presentation. Modern designs also prefer that the glass shower doors be self-centering, such that the doors will remain in the closed and properly aligned position without the need for the free edge to abut against a fixed sealing member or jamb mounted on the opposing wall or panel member. To this end, a number of pivot hinges for glass doors and self-centering pivot hinges have been developed.

Examples of such devices or systems are disclosed in U.S. Pat. No. 1,312,667, issued to Ayres on Aug. 12, 1919, U.S. Pat. No. 1,318,824, issued to Alary on Oct. 18, 1917, U.S. Pat. No. 4,200,956 to Ullman, Jr. on May 6, 1980, U.S. Pat. No. 5,417,272, issued to Marlowe et al. on May 23, 1995, U.S. Pat. No. 5,613,276, issued to Franz on Mar. 25, 1997, and U.S. Pat. No. 6,161,255, issued to Garrett on Dec. 19, 2000.

The Ayers hinge device has a base plate member having a semi-circular groove within which a ball bearing mounted on the underside of the door rides as the door is opened in either direction. Depressions are provided at each end of the groove and in the middle, such that the door will be detained in each of these positions unless pivoted by force. The groove slopes on each side down to the middle depression, such that the weight of the door will cause it to self-center unless the ball bearing is detained by one of the end depressions. The Alery hinge uses a roller member mounted onto the underside of the door that rides on the upper edge of a symmetrical flange extending upward from the base plate member, the flange bottoming out in the center and having a pair of dips on each side corresponding to the 90 degree open position for the door. Ullman, Jr. discloses a unique mounting system using a standard pivot hinge. Marlowe et al. shows a pivot hinge with a base member having an upwardly extending flange with a pair of opposing deep depressions extending in a direction perpendicular to a pair of opposing shallow depressions, where a horizontally disposed pin member rides on the upper edge of the flange. Franz discloses a pivot hinge wherein the base plate member has a circular recess with pair of opposing depressions that receive a horizontally disposed, semi-cylindrical member mounted on the underside of the door mount member and extending to either side of the vertical post member. Garrett shows an improved but complicated pressure hinge, wherein the self-centering is accomplished due to spring-biased roller pins that are pressed laterally against a pivoting cylindrical member with a pair of vertical channels disposed thereon. All of these devices either involve mechanical components which complicate the operation of the hinge and require excessive mounting and hardware components such that utilizing the hinges with a glass door is not aesthetically pleasing, or are excessively complicated requiring difficult installation, adjustment and cleaning, or do not adequately meet the need for efficient self-aligning.

It is an object of this invention to provide a pivot door hinge device and system that overcome and avoid the problems inherent in the known systems. It is a further object to provide such an invention that is most suitable for use with a glass door, such that the door will be self-centering or self-aligning in the closed position, yet can be easily opened and closed. It is a further object to provide such an invention that is relatively easy to manufacture and install, that is aesthetically pleasing, and that is easy to clean and maintain. It is a further object to provide such an invention that operates in a relatively simple manner, such that mechanical components are minimized and biasing members are not required for operation.

SUMMARY OF THE INVENTION

The invention is in general a base pivot door hinge, primarily intended for use with glass shower doors but which may be used with any type of door or panel member where a pivoting opening movement is desired. The hinge forms a part of door system in conjunction with a second hinge, such that the door is supported on its bottom edge by a pivot hinge of novel design mounted onto a stationary lower horizontal structural member such as a floor, curb, threshold or the like, while its top edge is retained by a pivot hinge which is affixed to either a stationary upper horizontal structural member such as a soffit, header, ceiling or the like, or to a lateral wall or other vertical member. Most preferably, both hinge devices are affixed to the door by clamping mechanisms, such that the door does not need to be notched, drilled or otherwise altered.

The base pivot mounting hinge comprises in general door attachment means to receive the door or panel member in a secure manner along its bottom edge, pivoting means to allow the door to be pivoted about a vertical axis, base attachment means to secure the device to a lower stationary surface, and self-centering means to cause the door to rest in a desired orientation and alignment. Structurally, the base pivot mounting hinge preferably comprises a U-shaped in cross-section channel member which receives the bottom edge of the door, the channel member having a generally rectangular bottom. A pivot pin member extends downward from the channel member and is received by a socket member disposed in a base plate member. The base plate member is preferably a generally flat member having a generally rectangular configuration, wherein the socket member is generally centrally positioned. A pair of longitudinally disposed parallel ridges extend upward on opposing sides of the base plate member to define a longitudinal channel having linear sides, the width of the channel being slightly greater than the width of the bottom of the channel member attached to the lower edge of the door, such that the channel member seats between the ridges when the door is aligned parallel to the pivot base member, the interior sides of the ridges acting to center the door and temporarily fix the door to prevent pivoting until sufficient pressure is applied. The ends of each of the ridges are beveled, sloped or curved such that the ridge diminishes in height towards each end.

Preferably, the inner edges of the ridge are beveled, sloped or curved as well, such that the interior wall of each ridge is not perpendicular to the upper surface of the base plate member.

The upper portion of the door is secured in a pivoting manner to an upper stationary support member, such as a horizontally disposed soffit, header or ceiling by an upper pivot hinge member. Alternatively, the upper pivot hinge may be affixed to a lateral wall or other vertical member. Preferably, the upper hinge member comprises clamping means for retaining the door along its upper edge.

In the passive or closed position, a door utilizing the hinge device of the invention remains aligned with and seats within the base plate channel, the bottom of the door receiving channel member residing between the two alignment ridges of the base plate. When the door is pivoted in either direction by applying force, one side of the bottom edge of the door receiving channel member will ride up the inclined end of one of the alignment ridges while the other side of the bottom edge of the door receiving channel member will ride up the inclined end of the other alignment ridge, lifting the door slightly. The door receiving channel member now rests on the upper surfaces of the alignment ridges. A transverse set of grooves, set for example perpendicularly to the base plate channel, may be cut into the alignment ridges, such that the door will be temporarily retained by the transverse grooves at a desired location. When the door is closed, the bottom of the door receiving channel slides along upper surface of the alignment ridges until it approaches the passive alignment, at which time the door receiving channel slides down the inclined ends of the ridges and seats within the base plate channel.

DETAILED DESCRIPTION OF THE INVENTION

With reference to the drawings, the invention will now be described in detail, with further regard for the best mode and the preferred embodiment. In a most general sense, the invention is a base pivot hinge device and assembly which supports a door or similar panel member in a manner which allows the door to be pivoted about a vertical axis, with the base pivot hinge typically positioned near a lateral edge of the door, wherein the construction of the base pivot hinge creates a self-centering or self-aligning effect such; that the door automatically assumes an aligned or centered position, typically the closed position relative to the door opening, when the door is pivoted to an orientation relatively near the centered position. The invention comprises such a base pivot hinge, as well as a system or apparatus as a whole incorporating an upper pivot hinge and the door or panel member in addition to the base pivot hinge. In another general sense, the invention is a base pivot hinge comprising means to receive and retain a door, base attachment means to affix the hinge to a lower stationary support member, pivoting means connecting the door receiving and retaining means to the base attachment means, and door self-centering means.

Figure 1:
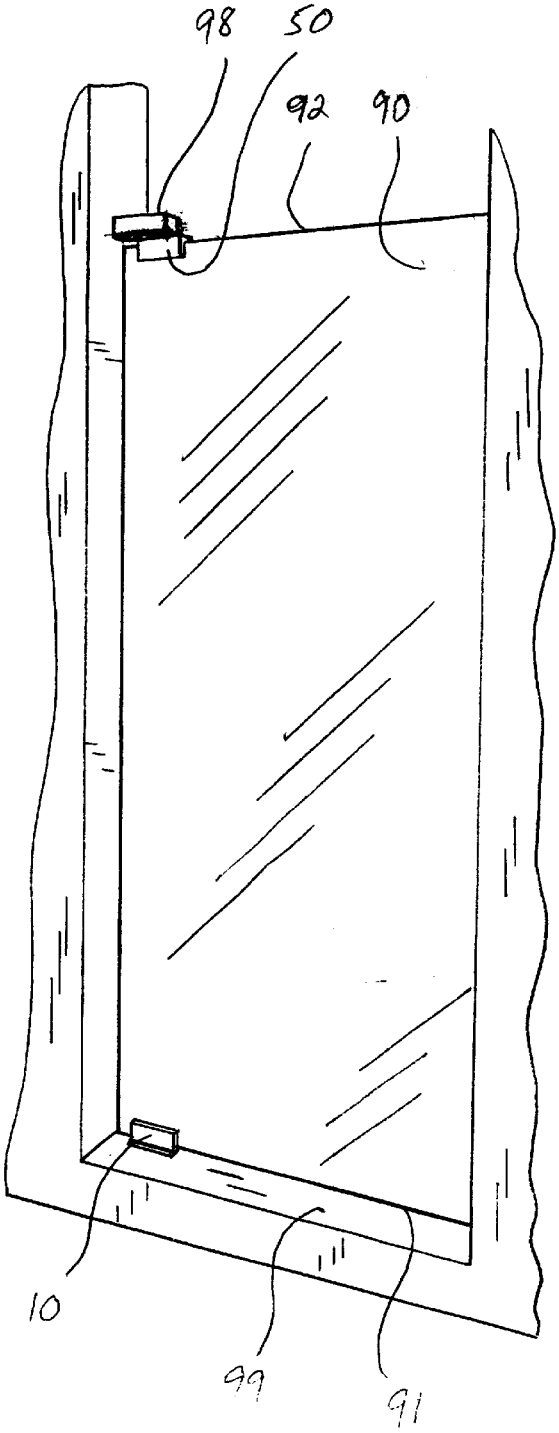
FIG. 1 is a view of a door mounted using the base pivot hinge member of the invention and showing the upper hinge member affixed to a wall.

A door pivoting system or apparatus incorporating the invention is illustrated in FIG. 1. A door or similar panel member 90, which may be composed of any material but which is shown herein as a glass door, is supported or suspended in a manner such that it may be pivoted about a vertical axis in one or opposing directions from a centered or aligned position, shown as the closed position in the illustration, into a non-centered or non-aligned open position. The door 90 is supported above a lower stationary support member 99, shown in the illustration as a raised curb of a shower stall, but which may comprise any fixed member disposed below the door 90, such as a floor, the bottom of a cabinet, a wall mount member, etc. The door 90 is suspended from an upper stationary support member 98, which is shown in the illustration as a wall mount device affixed to a lateral structural member of the door opening, but the upper stationary support member 98 may also be a soffit, a header, a ceiling, etc. The door 90 has a top or upper edge 92 and a bottom or lower edge 91, and the base pivot hinge is connected to the door 90 so as to retain or be disposed beneath the door bottom edge 91.

Figure 2:
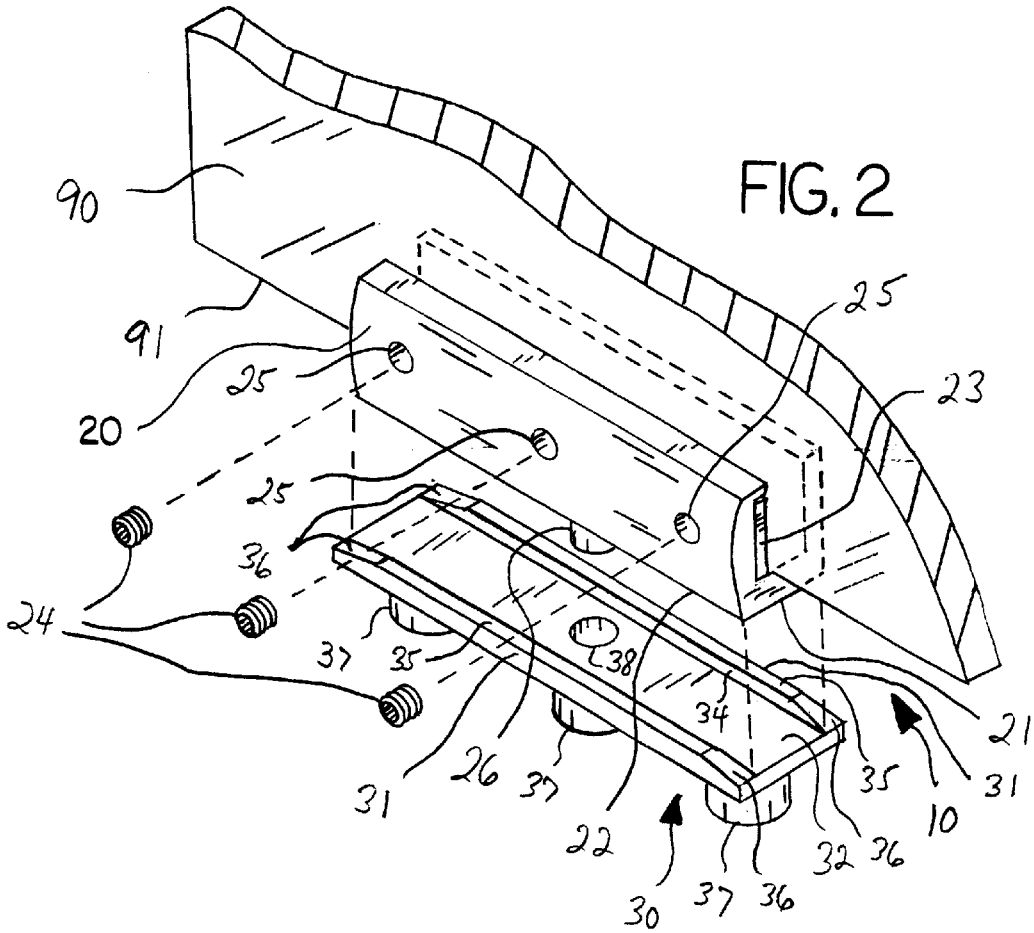
FIG. 2 is a perspective and partially exploded view of the base pivot hinge.
Figure 4:
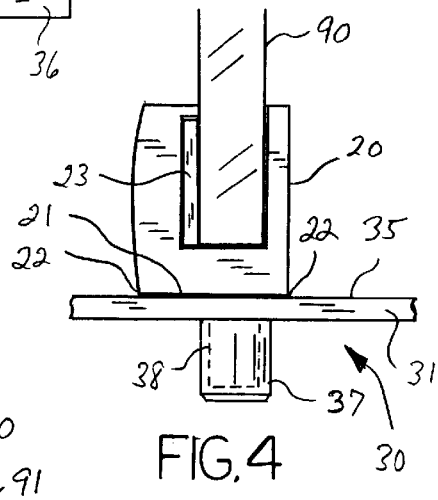
FIG. 4 is an end view of the base pivot hinge showing the door in the fully open position.
Figure 3:
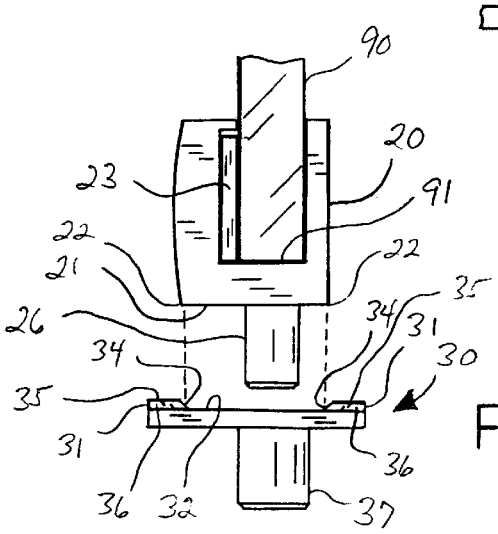
FIG. 3 is an end and partially exploded view of the base pivot hinge showing the door in the aligned or centered position.

The base pivot hinge 10 is detailed in FIGS. 2 through 4 and comprises in general a door receiving channel member 20 and a base plate member 30, wherein the base plate member 30 is adapted to be affixed in stationary manner to a lower stationary support member 99 and wherein the door receiving channel member 20 is adapted to pivot relative to the stationary base plate member 30 from an aligned or centered orientation, as depicted in FIGS. 2 and 3, to any non-centered or non-aligned orientation, such as depicted as a right angle orientation in FIG. 4. The aligned or centered orientation is defined herein as the orientation wherein the longitudinal direction of the channel member 20 and door bottom edge 91 is parallel to the longitudinal direction of the base plate member 30.

The door receiving channel member 20 is shown as a generally U-shaped member having a generally rectangular bottom 21 with a pair of opposing longitudinal linear edges 22, although it is to be understood that this terminology as used herein may also refer to any door receiving component which may be attached to the lower portion of the door 90 along the bottom edge 91 provided that the pair of linear edges 22 is presented. The U-shaped configuration as shown is most preferred in that this allows a door composed of glass or any other material to be retained with the necessity of cutting, notching, boring or otherwise altering and damaging the door 90. Retention of a glass door 90 as shown is accomplished by providing a rectangular compression plate member 23 that is disposed within the interior channel of the channel member 20 adjacent the door 90. Set screws 24 are then inserted into threaded apertures 25 and tightened to force the compression plate 23 securely against the door 90. Tape or other padding means may be inserted between the door 20 and the channel member 20 and compression plate 23 to protect the door surface. The lower linear edges 22 may be slightly rounded, beveled, chamfered or the like such that a right angle edge configuration is not present. A generally longitudinally centrally disposed pivot pin member 26 depends from the bottom 21 of channel member 20. The transverse position of the pivot pin 26 as shown is centered under the door 20, which results in it being offset relative to the channel member 20, which is provided with a thicker side to accommodate the set screws 24 and compression plate 23. The channel member 20 is preferably composed of a metal or a material of similar structural and durability properties.

Figure 6:
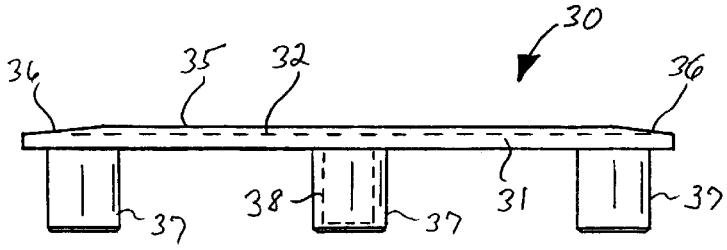
FIG. 6 is a side view of the base plate member of the base pivot hinge.
Figure 5:
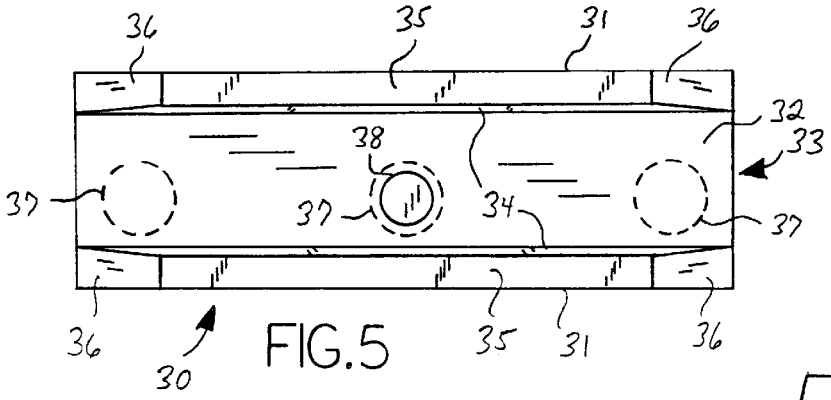
FIG. 5 is a top view of the base plate member of the base pivot hinge.

The base plate member 30 of the base pivot hinge member 10 is separately illustrated in FIGS. 5 and 6 in addition to FIGS. 2 through 4. The base plate member 30 is generally rectangular with a relatively low profile, and is adapted to be securely connected to or affixed to the lower stationary support member 99. The base plate member 30 is most preferably composed of a hard plastic, such as for example DELRIN brand plastic, which serves to reduce friction between the base plate member 30 and the door receiving channel member 20, but may alternatively be composed of metal or other materials of suitable properties. Means to affix the base plate member 30 to the lower stationary support member 99 may comprise any suitable mechanism, such as an adhesive, mechanical fasteners, mechanical interlock or the like, but preferably the base plate member 30 is provided with a plurality of depending mounting post members 37 as shown. The post members 37 are inserted into apertures bored into the lower stationary support member 99 and serve to prevent movement of the base plate member 30 in addition to the adhesive or mechanical fasteners. Generally longitudinally centrally disposed within the base plate member 30 is a pivot socket 38, which as shown is the hollow interior of the central post member 37. The pivot socket 38 as shown is off-centered transversely within the alignment channel 33 to correspond to the position of the pivot pin 26. The pivot socket 38 is sized to receive the depending pivot pin member 26 of the channel member 20 in a relatively snug manner, such that only rotational relative movement occurs between the pivot member 26 and the pivot socket 38, with minimal relative movement in the horizontal direction. While not preferred, it is also possible for the base pivot hinge to comprise a pivot pin that extends upward from the base plate member 30 and mates with a pivot socket disposed in the channel member 20.

The base plate member 30 further comprises a pair of opposing, parallel ridge members 31 which each extend upward a relatively short distance above a generally planar channel bottom surface 32. The pair of upstanding, opposing, parallel ridge interior walls 34 in combination with the channel bottom surface 32 define an alignment channel 33 extending in the longitudinal direction. The ridge members 31 further each comprise a ridge upper surface 35, preferably planar, and sloped end members 36. The sloped ends 36 are inclined, beveled, flattened, curved or otherwise tapered downward from the ridge upper surfaces 35, such that the height of the ridge interior walls 34 diminishes towards the outer ends of the base plate member 30. Most preferably, the ridge interior walls 36 are angled, beveled, chamfered or rounded, such that the linear junction between the interior walls 36 and the ridge upper surfaces 35 is not a right angle. In the most preferred embodiment, the ridge interior walls 34 are angled outwardly at about 45 degrees from the channel bottom surface 32, and the sloped ends 36 extend about ½ inch on a base plate member 30 which is about four inches long, with the height of the ridge members 31 being about $^{40}/_{1000}$ of an inch above the upper channel surface 32.

Figure 8:
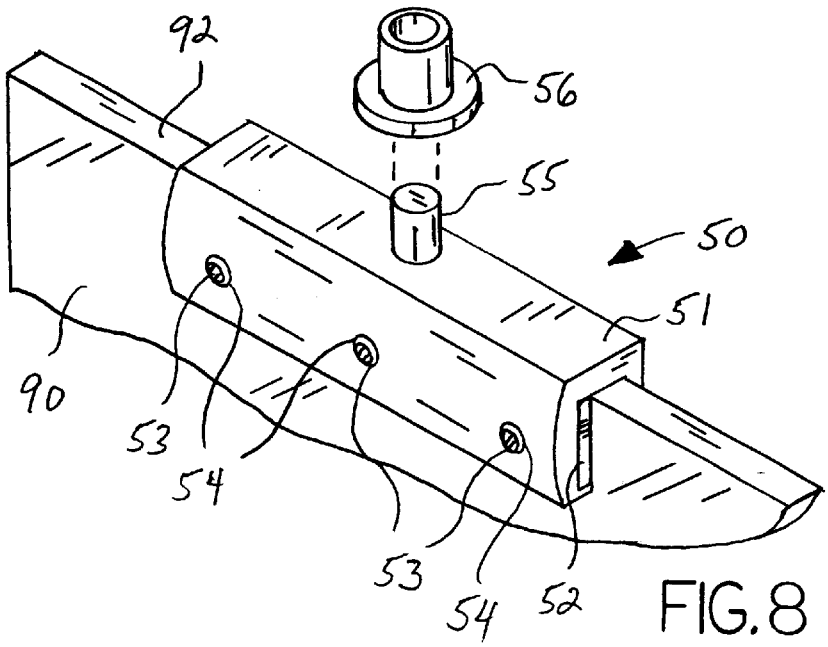
FIG. 8 is perspective view of an upper pivot hinge.

As shown in FIG. 8, the door top edge 92 is retained by an upper pivot hinge 50, which preferably comprises a generally U-shaped channel member 51 having a compression plate member 52 that is pressed against the door 90 by the insertions of set screws 53 into threaded apertures 54. An upwardly extending pivot pin member 55 is mounted generally centrally atop the channel member 51, such that the pin member 55 is received by a receiving socket 56 as shown, the receiving socket being adapted to be mounted into any upper stationary support member 98, such as for example a soffit, header, ceiling, lateral wall mount or similar device. The upper pivot hinge 50 is aligned with the base pivot hinge 10 to define a single vertical axis about which the door 90 will pivot. Alternative constructions for the upper pivot hinge 50 are possible, as the upper pivot hinge 50 serves as an alignment member rather than a true suspension member, the weight of the door 90 being borne by the base pivot hinge 10.

The base pivot hinge 10 works in the following manner. In the centered or aligned orientation, when the channel member 20 and bottom door edge 91 are aligned longitudinally with the fixed base plate member 30, the rectangular bottom 21 of the channel member 20 rests between the parallel ridge members 31 of the base plate member 30 with the linear edges 22 of the channel bottom 21 aligned in parallel with the ridge interior walls 34, preferably with the channel bottom 21 resting on the channel bottom surface 32 of the base plate member 30. In this manner the door 90 is retained in the desired centered orientation. The door 90 is opened by pulling or pushing such that the door 90 pivots about the vertical axis defined by the upper pivot hinge 50 and the base pivot hinge 10. As the door 90 begins to pivot the depending pivot pin member 26 rotates within the pivot socket 38 and the leading linear edges 22 of the channel member bottom 21 begin to ride up the ridge interior walls 34 and the sloped ends 36 of the base plate member 30, lifting the door 90 a distance equal to the height of the ridge members 31 once the door 90 has been pivoted beyond the sloping ends 36. The channel member bottom 21 now rests atop the ridge upper surfaces 35, as shown in FIG. 4, wherein the door 90 is oriented at 90 degrees from the centered orientation. The door 90 is closed by pivoting it back toward the centered orientation. As the orientation of the door 90 approaches the centered orientation, the rectangular bottom 21 of the channel member 20 begins to slide down the sloped ends 36 of the parallel ridge members 31. The weight of the door 90 causes the channel member 20 to automatically drop into the centered and aligned orientation between the ridge members 31, and the ridge interior walls 34 maintain the door 90 in the centered orientation until a force is applied to open it.

Figure 7:
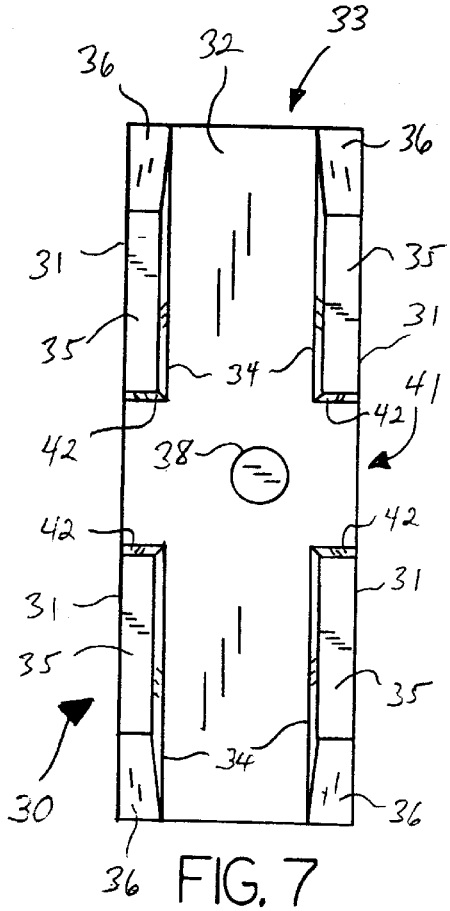
FIG. 7 is a top view an alternative embodiment of the base plate member.

An alternative embodiment for the base plate member 30 is illustrated in FIG. 7, which shows the provision of a transverse channel 41 extending perpendicularly to the alignment channel 33 at the location of the pivot socket 38. The transverse channel 41 is defined by the combination of the channel bottom surface 32 and two pairs of opposing transverse ridge walls 42 which join the ridge upper surfaces 35 to the channel bottom surface 32 in the same manner as the ridge interior walls 34. Preferably the transverse ridge walls 42 are angled, beveled, chamfered or rounded, such that the linear junctions between the transverse ridge walls 42 and the ridge upper surfaces 35 are not a right angle. In this embodiment, when the door 90 is pivoted 90 degrees from the aligned or centered orientation, the door 90 will be temporarily retained in the perpendicular orientation.

It is contemplated that equivalents and substitutions for certain elements set forth above may be obvious to those skilled in the art, and therefore the true scope and definition of the invention is to be as set forth in the following claims.

We claim:

1. A pivot door hinge device comprising door self-centering means;

said door self-centering means comprising a door receiving channel member having a generally rectangular bottom, and a base plate member comprising an alignment channel defined by a pair of generally parallel ridge members, wherein said channel member bottom is pivotable from a centered orientation within said alignment channel and between said ridge members to non-centered orientation wherein said channel member rests upon said ridge members.

2. The device of claim 1, wherein said ridge members each comprise sloping ends.

3. The device of claim 1, wherein said channel member further comprises a depending pivot pin member and said base plate member further comprises a pivot socket member which receives said pivot pin member.

4. The device of claim 1, wherein said channel member is generally U-shaped.

5. The device of claim 4, wherein said channel member further comprises a compression plate member.

6. The device of claim 1, wherein said ridge members further comprise angled ridge interior walls.

7. The device of claim 1, wherein said base plate member further comprises mounting posts.

8. The device of claim 1, wherein said base plate member further comprises a transverse channel extending perpendicularly to said alignment channel adapted to receive said channel member when said channel member is pivoted to a non-centered orientation corresponding to the orientation of said transverse channel.

9. A pivot door hinge device comprising:

a door receiving channel member comprising a generally rectangular bottom;

a base plate member comprising generally parallel ridge members and a channel bottom surface, said ridge members comprising ridge upper surfaces, ridge interior walls and sloped ends, said ridge interior walls and said channel bottom surface defining in combination an alignment channel adapted to receive said bottom of said channel member;

pivot means connecting said channel member to said base plate member whereby said channel member may pivot from a centered orientation with said channel member bottom disposed within said alignment channel to a non-centered orientation with said channel member disposed on said ridge upper surfaces.

10. The device of claim 9, wherein said pivot means comprises in combination a depending pivot pin member extending beneath said channel member and a pivot socket disposed in said base plate member.

11. The device of claim 9, wherein said channel member is generally U-shaped and further comprises a compression plate member.

12. The device of claim 9, wherein said ridge interior walls are angled.

13. The device of claim 9, wherein said base member further comprises mounting post members.

14. The device of claim 9, said base member further comprising a transverse channel extending perpendicularly to said alignment channel.

15. A pivoting door assembly for pivotally mounting a door between an upper stationary support member and a lower stationary support member, said assembly comprising:

a door member;

a base pivot hinge member connected to said door member;

an upper pivot hinge member connected to said door member;

said base pivot hinge member comprising a door receiving channel member comprising a generally rectangular bottom pivotally connected to a base plate member having generally parallel ridge members and a channel bottom surface, said ridge members comprising ridge upper surfaces, ridge interior walls and sloped ends, said ridge interior walls and said channel bottom surface defining in combination an alignment channel adapted to receive said bottom of said channel member in a centered orientation;

whereby said channel member is pivotable from said centered orientation to a non-centered orientation wherein said channel member rests on said ridge upper surfaces.

16. The assembly of claim 15, wherein said channel member further comprises a depending pivot pin member and said base plate member further comprises a pivot socket.

17. The assembly of claim 15, wherein said ridge interior walls are angled.

18. The assembly of claim 15, wherein said channel member is generally U-shaped and further comprises a compression plate member.

19. The device of claim 15, wherein said base member further comprises mounting post members.

20. The device of claim 15, said base member further comprising a transverse channel extending perpendicularly to said alignment channel.

* * * * *